US007114577B2

(12) United States Patent
Newman

(10) Patent No.: US 7,114,577 B2
(45) Date of Patent: Oct. 3, 2006

(54) SAFEMODE OPERATING SYSTEM FOR A DRILLING OR SERVICE RIG

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 92 days.

(21) Appl. No.: 11/066,576

(22) Filed: Feb. 25, 2005

(65) Prior Publication Data

US 2005/0199388 A1 Sep. 15, 2005

Related U.S. Application Data

(60) Provisional application No. 60/548,838, filed on Feb. 27, 2004.

(51) Int. Cl.
*E21B 3/06* (2006.01)
*E21B 44/00* (2006.01)
*E21B 44/04* (2006.01)

(52) U.S. Cl. ..... 175/27; 175/24; 175/40; 254/274

(58) Field of Classification Search ..... 175/27, 175/40

See application file for complete search history.

(56) References Cited

U.S. PATENT DOCUMENTS

| | | | | |
|---|---|---|---|---|
| 4,434,971 | A * | 3/1984 | Cordrey | 254/273 |
| 6,029,951 | A * | 2/2000 | Guggari | 254/269 |
| 6,155,357 | A * | 12/2000 | King et al. | 175/27 |
| 6,192,998 | B1 * | 2/2001 | Pinckard | 175/27 |
| 6,233,498 | B1 * | 5/2001 | King et al. | 700/174 |
| 6,293,356 | B1 * | 9/2001 | King et al. | 175/27 |
| 6,994,172 | B1 * | 2/2006 | Ray | 175/24 |
| 7,029,422 | B1 * | 4/2006 | Newman et al. | 477/175 |
| 7,044,239 | B1 * | 5/2006 | Pinckard et al. | 175/57 |

* cited by examiner

*Primary Examiner*—David Bagnell
*Assistant Examiner*—Nicole A Coy
(74) *Attorney, Agent, or Firm*—King & Spalding LLP

(57) ABSTRACT

Disclosed herein is a system designed to manage or slow the block travel speed down to safe speeds when the rig is operating in a light load/high speed condition. The system monitors and controls engine torque and horsepower, providing the minimum amount of each necessary to pull the light load out of the hold without providing sufficient excess torque to pull the load through a snag.

18 Claims, No Drawings

SAFEMODE OPERATING SYSTEM FOR A DRILLING OR SERVICE RIG

This application is based on U.S. Provisional Patent Application Ser. No. 60/548,838, entitled "Safemode Operating System for an Oil Well Rig" by Fred M. Newman, filed Feb. 27, 2004, incorporated by reference in its entirety herein.

BACKGROUND OF THE INVENTION

Throughout the history of drilling and servicing oil wells, accidents, some even involving fatalities, frequently occur when a rig is pulling tubulars and runs the tubulars into a wellhead, BOP, slips, or other stationary apparatus. Normally, when the rig is pulling shallow and has a light load, the block speed is fast and there is little time to react to unexpected occurrences. Compounding the speed problem, there is no forgiveness or stretch in tubing or drillpipe, and thus, when the pipe hangs up, damage and accidents frequently occur.

When a rig starts pulling tubulars out of a wellbore, the operator or driller will select the most efficient gear to pull the load based on the weight of the hookload and the desired speed of the pull. More often than not the operator pulls as fast as possible, however the block pulling speed is limited by both the prime mover (engine) horsepower and the gear train transferring the power from the engine to the hoist. Since hookloads coming off bottom of a hole can be high, the normal rig with the normal operator will start off bottom pulling slowly (engine maxed out but still slow block movement) and as the hookload decreases with less pipe in the hole, the pulling speed or block velocity will increase. This is primarily due to the reduced horsepower requirement to lift the lighter load.

Drillpipe, tubing, and rods all have a known modulus of elasticity and exhibit the ability to stretch. For example, if a rig has 10,000 feet of surface measured tubing that weighs 45,000 pounds, and the tubing is not moving, the weight indicators will sense 45,000 pounds provided the pipe is hanging free and is vertical. The bottom of the tubing will be at approximately 10,003 feet due to normal free hanging stretch.

When subjected to forces in excess of the free hanging weight, such as being getting stuck in the hole where the bottom of the tube is stationary and the top of the tube being pulled by the block is moving, the tubular string will elongate. The amount of additional stretch can be defined with the following equation:

$$1)\ \text{Stretch (in)} = \frac{[\text{Length of pipe in hole}] * [\text{Differential Pull}]}{[735,000 * [\text{Weight of pipe}]}$$

When a tubular gets stuck deep in a hole, the operator's reaction time is significantly longer than when a tubular gets stuck near the surface. For example, if a 2⅜" tubular at 4.5 pounds per foot gets stuck at 10,000 feet, the free hanging weight is 45,000 pounds. The maximum desired pull would then be 65,000 pounds, which is based on a calculated value based on the 90% of yield point of new tubing. If the rig operator were to pull an additional 20,000 pounds over the free hanging weight (i.e. the 65,000 pound maximum), the total stretch in the tubing would be:

$$S=[10{,}000\ \text{feet}*20{,}000\ \text{pound over pull}]/[735{,}000*4.5\ \#/\text{ft}]=60\ \text{inches} \quad 2)$$

Using this equation and applying it to the rig pulling out of the hole, a determination can be made as to what the operator sees when the pipe sticks while being pulled. Assuming the rig's pulling speed is, at that depth and weight, about 60 feet per minute or one foot per second, and knowing from equation 2 that a 20,000 pound over pull yields a 60 inch stretch, the time that is taken from sticking to a 20,000 pound over pull can be calculated as follows:

$$T=D/V \quad 3)$$

Where D is the distance pulled, V=velocity and T is time. Knowing that at a 20,000 over pull the tubular stretches 60 inches, or 5 feet, and that the velocity at that depth is 1 foot per second, time can be calculated as follows:

$$T=5/1\ \text{or five seconds} \quad 4)$$

In other words, if the tubing sticks near the bottom of the hole, the operator has approximately five seconds to react and stop the blocks prior to reaching the maximum allowable pull of 65,000 pounds, i.e. a 20,000 pound overpull. Of course, the greater the speed, the less reaction time is afforded the operator, however overpull is normally quickly noticed by the operator, and therefore the operator usually has time to shut the rig down and take evasive action to avoid and overpull.

Comparing the deep hole sticking example to a shallow sticking example magnifies the problem facing the drilling and well servicing industry. Assume that the same tubular is at a depth of only 500 feet, the tubular has a hanging weight of 2,250 pounds, at the same 4.5 pounds per foot. Now the rig operator has more than enough horsepower to pull at almost any speed, but still does not want to pull more than 65,000 pounds, which in this case is a 62,750 pound overpull. Using equation 1, the tubular stretch in this example is calculated as follows:

$$S=[500\ \text{feet}*62{,}750\ \text{over pull}]/[735{,}000*4.5\ \#/\text{ft.}]=9\ \text{inches} \quad 5)$$

Assuming the pulling speed for a light load is fast at four feet per second, using equation 3 the time for this "almost out of the hole" example can be calculated as follows:

$$T=0.75/4=0.1875\ \text{seconds to react.} \quad 6)$$

As shown, the time to travel the 9 inches, i.e. to stretch from hanging weight to maximum pull (¾ of a foot), at 4 feet per second is 0.1875 seconds, significantly slower than when the tubular gets stuck deep in the hole. Even if the rig is operated at a much lower gear and the pulling speed is slowed to 1 foot per second, using equation 3 again to calculate time, it can be shown that there is still not enough time (¾ of a second) to properly react to a shallow sticking situation:

$$T=0.75/1=\tfrac{3}{4}\ \text{second to react.} \quad 7)$$

As shown, when the rig has hole problems that cause sticking, if there is an ample length of tube in the hole, the operator has a sufficient amount of time to react. If, on the other hand, the length of the tube is short and the rig is being operated at its maximum capacity, there is little or no time to react and the chances of a catastrophic event greatly increase. It remains therefore incumbent to find a solution to this problem to provide the rig and crew an extra level of safety to prevent such catastrophes.

SUMMARY OF THE INVENTION

Disclosed herein is a system designed to manage or slow the block travel speed down to safe speeds when the rig is operating in a light load/high speed condition. The system monitors and controls engine torque and horsepower, providing the minimum amount of each necessary to pull the light load out of the hold without providing sufficient excess torque to pull the load through a snag.

The system can either be manually activated, or can be automatically activated when the hook load falls below some predetermined value. When in operation, the system sets a maximum engine RPM to pull the load from the hole, and advises the operator as to the highest gear available to pull the load. The system activates a transmission mounted solenoid that relieves pressure from the lock up clutch cylinder line, keeping the system in a slippage mode and out of the lock up mode. The system further energies a DTL (Digital Torque Limiting) feature of the engine, limiting the output horsepower of the engine. Finally, the system may also limits the clutch bladder air pressure on the tubing hoist to keep the system operating in the safemode state. This system is applicable to all rigs used in the field, including, but not limited to, drilling rigs and well servicing rigs.

DESCRIPTION OF ILLUSTRATIVE EMBODIMENTS

One embodiment of the present invention limits the available horsepower to the engine while pulling a light load. A rig pulling tubing or drillpipe needs some calculable amount of horsepower to both pull the hookload and power the tongs to unscrew the tubing. More horsepower is obviously required to pull 5,000 feet of tubing than it does to pull 500 feet of tubing at the same speed. Most rigs currently working in the field have 400 HP deliverable to the hoist. This is optimal when pulling tubing from deep in the hole, but can be dangerous when working shallow, as having too much horsepower when an unexpected event occurs may lead to over stressing the equipment and a possible accident.

A generic rig pulling tubing from 1,000 feet utilizes less than 550 ft-lb or torque. The same rig, pulling 5000 feet of tubing uses 2,500 ft-lb of torque. The pulling speed dictates the actual horsepower being utilized by the engine. It would appear that when the rig is shallow and only needing the 550 ft-lb of torque, excess torque is not used in the pulling task, but instead is available to overpull or overstress the tubular. Therefore limiting the horsepower supplied to power the hoist to only the needed amount of torque necessary to pull the tubing would add a level of safety to the rig crew. Then, for example, if a packer hangs in the wellhead, the engine and torque converter will stall before the tubing can be overstressed.

Limiting the torque can be accomplished in modern engines (series 60 or other brands of EDC type) by flipping a switch that reconfigures the fuel map. This process is called "DTL" which is an acronym for "Digital Torque Limiting." To the computer responsible for engine control, DTL is nothing more than changing the fuel flow to the engine when commanded to do so. The engine computer in the normal mode will inject the appropriate amount of fuel into the engine so as to obtain a desired RPM. In the DTL mode, the fuel flow to the engine is reduced, resulting in the engine obtaining the desired RPM, but at a reduced torque output. Initiating DTL when the hookload falls below a specified minimum can provide some protection to the rig components and crew by preventing a catastrophic event.

A further embodiment of the present invention includes limiting the drum clutch air pressure. The tubing drum clutch is the mechanical link between the rotating components of the drive train and the hoist. Normally, this drum air clutch is activated by air pressure in excess of 100 psi. Since the drum clutch is normally a friction type clutch, the total applied force is always at its maximum, which minimizes clutch slippage. Minimizing clutch slippage is desirable when pulling heavy loads. When the loads are light, however, the "load heavy" clutch slippage problem is no longer a problem. In fact, if a tubular gets stuck in the hole, the lack of slippage becomes problematic, instead of being beneficial.

To allow for clutch slippage during light load operations, a second air line feeding the clutch can be installed. The main line, currently in use on all rigs, would be used to supply full air to the clutch bladder and would be used when pulling heavy loads. The second path or line, activated by a simple solenoid valve once the hook load falls below a specified minimum value, runs through a pressure regulator before feeding the clutch bladder. If the pressure output from the regulator was limited to, for example, 40 psi, the clutch would slip when the hook load exceeds 40,000 pounds, adding a further level of safety should the tubulars be unexpectedly held up.

A further embodiment of the present invention includes introducing slippage into the torque converter. The engine provides power to the hoist via a torque converter, a transmission, and then to a gear train which drives the chains and, finally, the hoist. When the rig is lifting heavy loads, the engine throttles up and spins a turbine pump. The fluid energy from this turbine pump is transferred via the stator to a turbine wheel, the turbine wheel then spins the turbine shaft which in turn drives a gear reduction train that ultimately drives the output shaft that transfers the engine energy to the hoist. The engine starts off at an idle and then builds RPM, putting more energy into the turbine via the pump. Initially, there is a great deal of slippage between the pump and the turbine, but as the output turbine shaft gains speed and the engine reaches a high RPM, there is less need for this slippage. As the engine reaches a high RPM, the turbine pump sensor or pitot tube senses high pressure due to high engine RPM and then transfers fluid to a piston concentric to the turbine shaft which activates the lockup clutch. With the lock up clutch activated, the engine is now directly coupled to the turbine shaft which drives the non-slipping transmission and gear train. When the transmission is in lock up, the torque converter (slippage provider) is out of the circuit, resulting in there being a direct mechanical coupling between the 400 HP engine and the hoist with no slippage.

Managing the torque converter and keeping the system out of lock up during light load events can help a rig by insuring slippage, thereby adding another level of safety when we are pulling the last bit of tubing out of the hole. During normal rig operations, i.e. when running under heavy loads, fluid from the engine driven turbine pump activates the lockup system which runs at about 90 psi. When the pump fluid pressure reaches some set value, the fluid applies pressure to the lock up clutch pressure plates and, as long as the plates sense pressure, lockup is engaged. There is an exhaust port on the outside housing of the transmission that is usually marked as "front governor pressure." Placing a normally closed solenoid valve at this port and activating this valve when slippage is needed (i.e. pulling light loads) allows the lockup fluid pressure to return to the fluid reservoir, keeping the torque converter out of lock up. If the valve is not activated, the transmission and torque converter behave as normal and go into lock up when needed.

While the apparatuses and methods of this invention have been described in terms of preferred embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A method for preventing a light load catastrophic event on an oil rig comprising:

specifying a minimum hook load weight, monitoring the hook load weight, limiting the engine horsepower supplied to power the oil rig hoist to only the needed amount of torque necessary to pull tubulars from a well once the hook load weight falls below the specified minimum hook load weight.

2. The method of claim 1, wherein the engine horsepower is limited using a digital torque limiting process.

3. The method of claim 1, wherein the hook load weight monitoring and engine horsepower limiting steps are done manually.

4. The method of claim 1, wherein the hook load weight monitoring and engine horsepower limiting steps are done automatically.

5. The method of claim 1, wherein the engine horsepower limiting step is accomplished by reducing fuel flow to the engine.

6. The method of claim 1, wherein the oil rig is a drilling rig or a well service rig.

7. A method for preventing a light load catastrophic event on an oil rig comprising:

specifying a minimum hook load weight, monitoring the hook load weight, reducing the pressure applied to the drum clutch bladder once the hook load weight falls below the specified minimum hook load weight.

8. The method of claim 7, wherein the hook load weight monitoring and drum clutch bladder pressure reduction steps are done manually.

9. The method of claim 7, wherein the hook load weight monitoring and engine horsepower limiting steps are done automatically.

10. The method of claim 7, wherein the oil rig is a drilling rig or a well service rig.

11. A method for preventing a light load catastrophic event on an oil rig comprising:

specifying a minimum hook load weight, monitoring the hook load weight, introducing slippage into the oil rig torque converter once the hook load weight falls below the specified minimum hook load weight.

12. The method of claim 11, wherein slippage is introduced into the torque converter by keeping the torque converter out of lock up mode.

13. The method of claim 12, wherein the torque converter is kept out of lock up mode by relieving the fluid pressure from the oil rig engine driven turbine pump.

14. The method of claim 11, wherein the hook load weight monitoring and introducing slippage into the oil rig torque converter steps are done manually.

15. The method of claim 11, wherein the hook load weight monitoring and introducing slippage into the oil rig torque converter steps are done automatically.

16. The method of claim 11, wherein the oil rig is a drilling rig or a well service rig.

17. A method for preventing a light load catastrophic event on an oil rig comprising:

specifying a minimum hook load weight, monitoring the hook load weight, limiting the engine horsepower supplied to power the oil rig hoist to only the needed amount of torque necessary to pull tubulars from a well once the hook load weight falls below the specified minimum hook load weight, reducing the pressure applied to the drum clutch bladder once the hook load weight falls below the specified minimum hook load weight, and introducing slippage into the oil rig torque converter once the hook load weight falls below the specified minimum hook load weight.

18. The method of claim 17, wherein the oil rig is a drilling rig or a well service rig.

* * * * *